United States Patent [19]

Watt et al.

[11] Patent Number: 4,894,907

[45] Date of Patent: Jan. 23, 1990

[54] METHOD OF MAKING A LONGITUDINALLY CONTOURED CONDUCTOR FOR INDUCTIVE ELECTRICAL DEVICES

[75] Inventors: Julian A. Watt, Falls Villiage; Richard S. Lenzing, Farmington, both of Conn.

[73] Assignee: The Superior Electric Company, Bristol, Conn.

[21] Appl. No.: 293,793

[22] Filed: Jan. 5, 1989

Related U.S. Application Data

[60] Division of Ser. No. 201,342, May 27, 1988, which is a continuation-in-part of Ser. No. 900,118, Aug. 25, 1986, abandoned.

[51] Int. Cl.[4] ..... H01F 41/07

[52] U.S. Cl. ..... 29/602.1; 219/121.69; 219/121.82

[58] Field of Search ..... 219/121.67, 121.68, 219/121.69, 121.82; 29/602.1, 605

[56] References Cited

U.S. PATENT DOCUMENTS

| | | | |
|---|---|---|---|
| 2,604,519 | 7/1952 | Meckereth | 336/223 X |
| 2,735,979 | 2/1956 | Coben | 336/233 X |
| 3,293,587 | 12/1966 | Robinson | 29/602.1 X |
| 3,530,573 | 9/1970 | Helgeland | 219/121.69 X |
| 3,916,144 | 10/1975 | Schuermann | 219/121.69 |
| 4,042,006 | 8/1977 | Engl et al. | 219/121.69 X |
| 4,566,936 | 1/1986 | Bowlin | 219/121.69 X |

FOREIGN PATENT DOCUMENTS

| | | |
|---|---|---|
| 811392 | 12/1935 | France . |
| 718748 | 11/1954 | United Kingdom . |

*Primary Examiner*—Carl E. Hall

*Attorney, Agent, or Firm*—John H. Crozier

[57] ABSTRACT

A method for making an improved conductor for an inductor device of the type having varying current carrying requirements along the length of the conductor, the improvement comprising having the conductor contoured such that the cross-sectional area of the conductor varies substantially directly as the current carrying requirements of the conductor vary. In one embodiment, a coil for a variable transformer is cut from a cylinder of conductor material by numerically controlled machining, producing a contoured conductor and eliminating the requirement for coiling or winding of the conductor. A brush guide groove may also be provided in the conductor.

8 Claims, 5 Drawing Sheets

METHOD OF MAKING A LONGITUDINALLY CONTOURED CONDUCTOR FOR INDUCTIVE ELECTRICAL DEVICES

CROSS-REFERENCE TO RELATED APPLICATIONS

This application is a division of co-pending U.S. patent application Ser. No. 07/201,342, filed May 27, 1988, which is a continuation-in-part of abandoned U.S. patent application Ser. No. 06/900,118, filed Aug. 25, 1986.

BACKGROUND OF THE INVENTION

1. Field of the Invention

The present invention is related to inductive electrical devices in which there is a varying current density and, more particularly, to a method for making a longitudinally contoured conductor for such devices which minimizes the quantity of required conductor material.

2. Background Art

Inductive electrical devices are well known and widely used in electrical systems as energy transfer or storage elements and include, for example, variable transformers and certain types of choke coils and reactors in which a coiled conductor induces a voltage in itself or another coil, frequently in association with a paramagnetic flux-carrying material.

The conductors of such devices are typically formed of round, rectangular, or square conductors with the conductor in any such device having a uniform cross-section substantially throughout its length. The current handling requirements in a conductor in such devices may change with respect to the position in the conductor; however, by using constant-cross-section conductors, the coils are designed to withstand the maximum currents throughout the coil when, in actuality, only certain portions of the coil carry the maximum currents. This conventional configuration wastes conductor material and results in a device that is heavier and larger than need be for the current carried.

SUMMARY OF THE INVENTION

The present invention overcomes the above limitations of conventional devices by providing a method for making a coil for an inductive device that is longitudinally contoured so that it has maximum cross-sectional area in those portions where maximum current is carried and lesser cross-sectional areas, proportional to the current carried, in other portions of the coil.

DESCRIPTION OF THE PREFERRED EMBODIMENT

Figure 1:
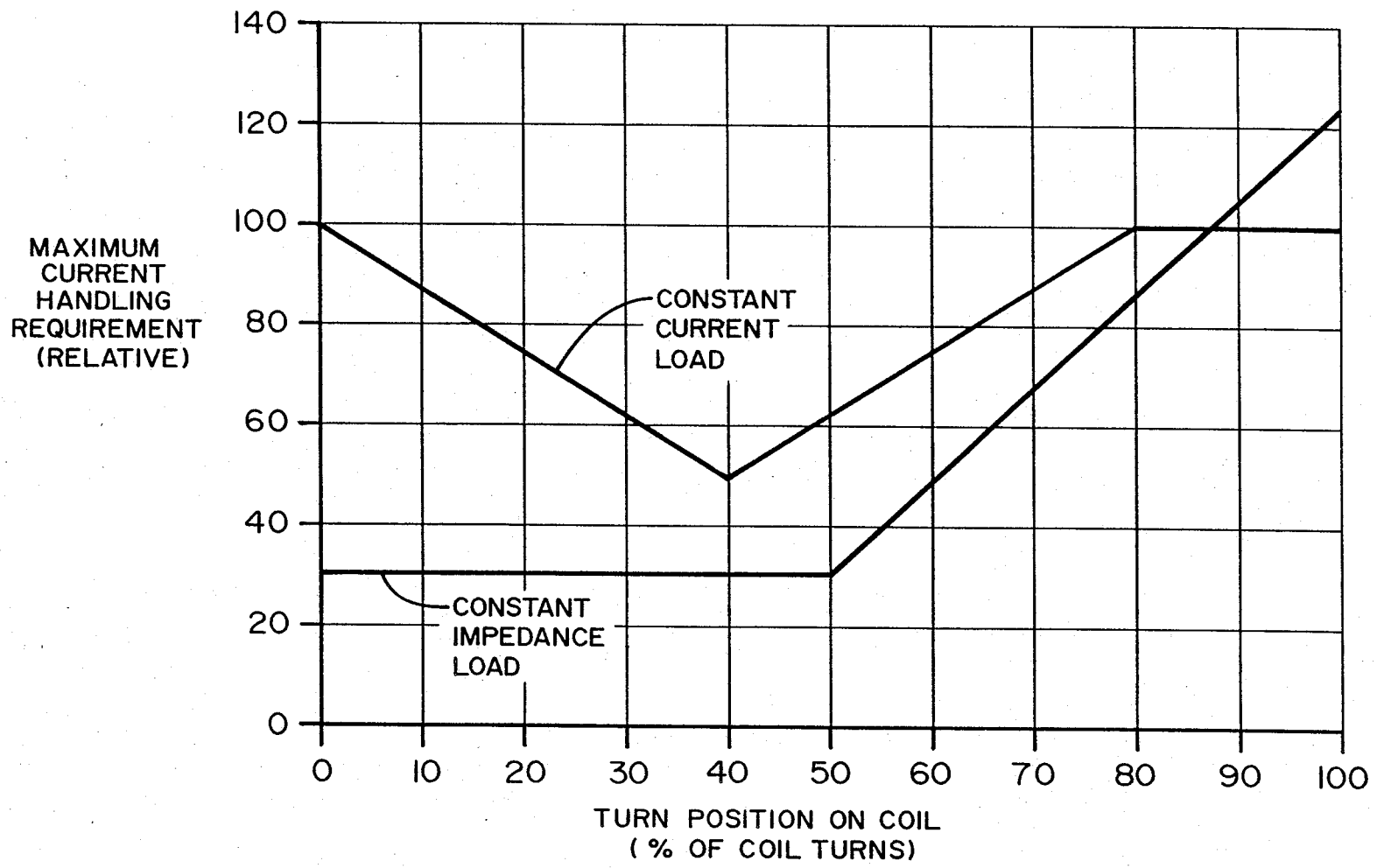
FIG. 1 is a graph of current versus coil position for a typical variable transformer.

Referring now to the Drawing, FIG. 1 is a graph, for a typical variable transformer, of the maximum current handling requirement of the transformer coil versus the turn position on the coil. Curves are shown for both constant current load operation and constant impedance load operation. For constant current load operation, it is seen that, at the beginning of the coil, the current is at its maximum, drops to about one-half of maximum, and then rises to and remains at maximum along the last 20 percent of the coil. For constant impedance load operation, the current is at a low level along the first half of the coil and then rises along the rest of the coil.

Figure 2:
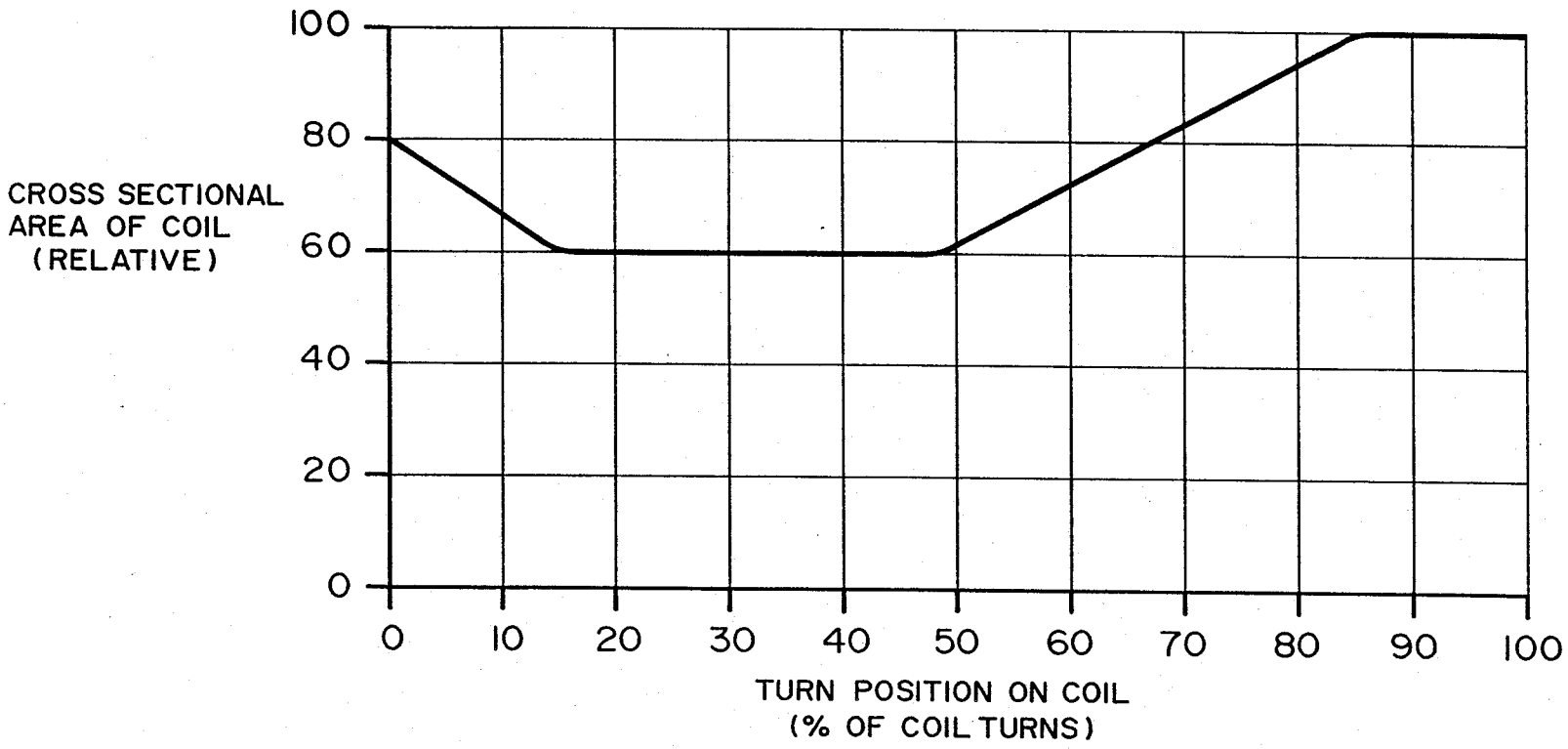
FIG. 2 is a graph showing an improved coil cross-sectional area for the variable transformer of FIG. 1, according to the present invention.

FIG. 2 shows how a coil might be contoured, in accordance with the present invention, for the transformer requirements shown on FIG. 1. The contouring indicated satisfies the requirements for both constant current and constant impedance load conditions. At the beginning of the coil, the cross-sectional area is relatively large to handle constant current load condition, drops to a lower level when the current is relatively low under either load condition, and then rises to its maximum toward the end of the coil to handle the maximum current under constant impedance load operation.

Figure 3:
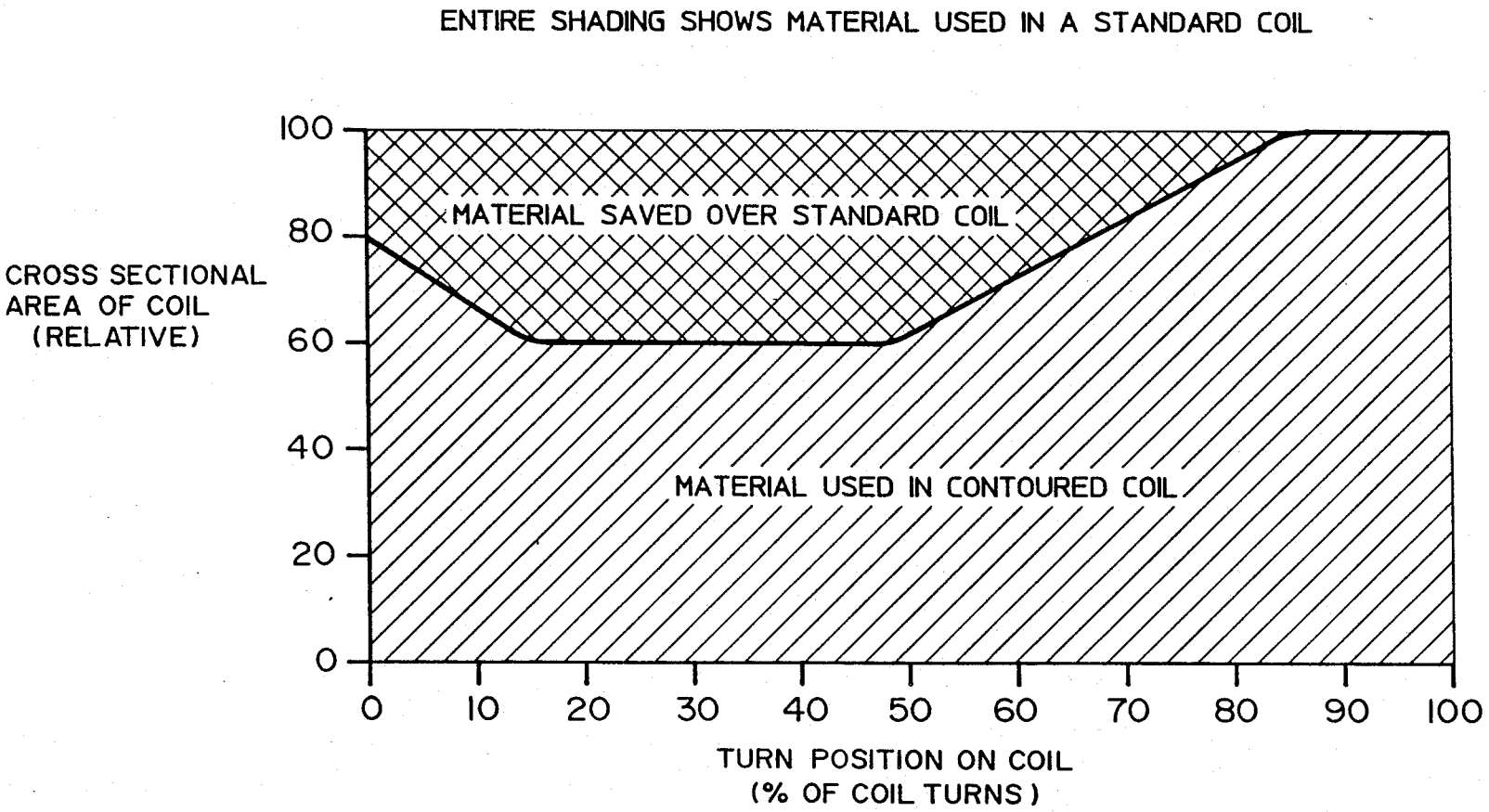
FIG. 3 is a graph showing material used and saved over conventional construction in the variable transformer of FIG. 2.

FIG. 3 is FIG. 2 shaded to show coil material saved by the present invention over conventional construction. For the design under consideration, there is a savings of about 20 percent in coil material.

Figure 4:
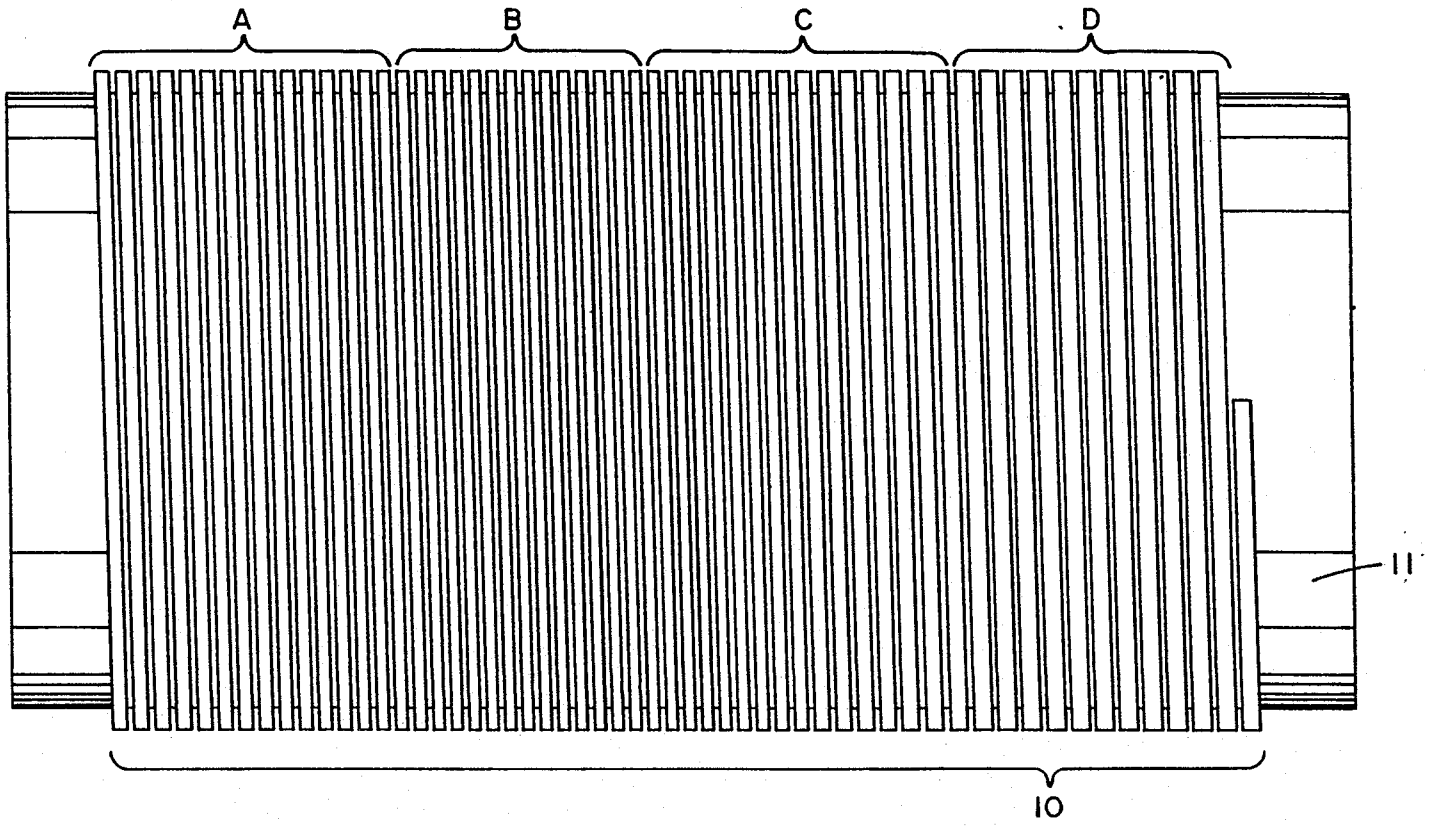
FIG. 4 is a view of a coil constructed according to the present invention.

FIG. 4 shows a coil constructed according to the present invention and includes a conductor 10 on the surface of a tube of insulating material 11. Beginning at the left end of the coil 10, section "A" begins with relatively wide coil turns decreasing to the minimum width section "B". The width of the coil turns increase through section "C" to the maximum width coil turns in section "D" at the right end of the coil 10. The contouring is substantially as shown on FIG. 2.

Figure 5A:
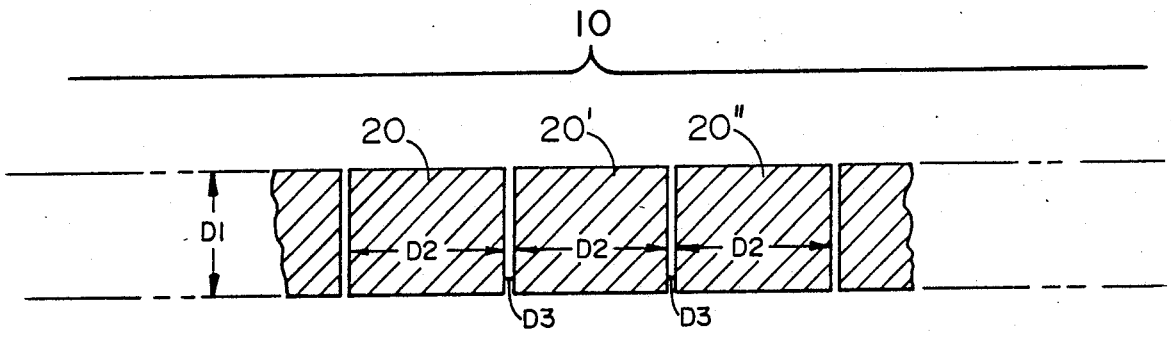
FIGS. 5(*a*)–(*c*) are fragmentary cross-sectional views of a portions of conductors constructed according to alternative embodiments of the present invention.
Figure 5B:
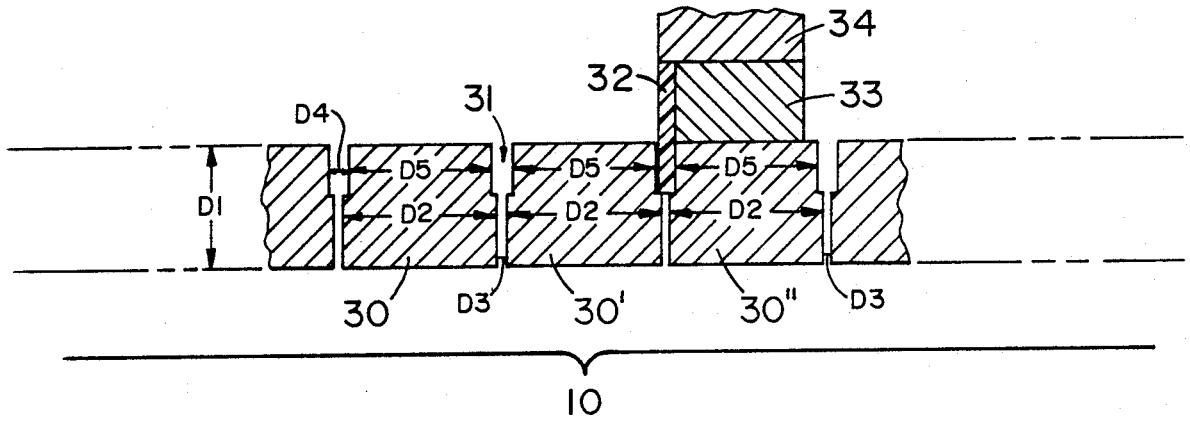
Figure 5C:
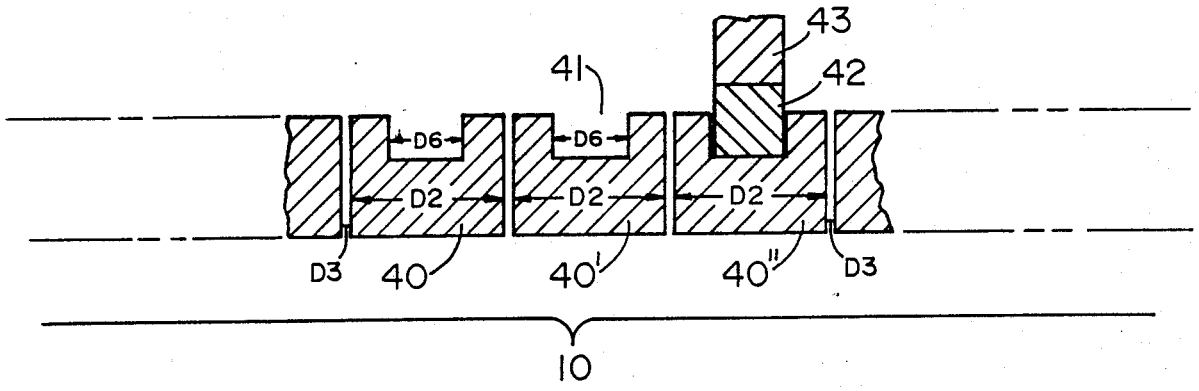

FIG. 5(*a*) is a cross-sectional view of adjacent coil turns 20, 20', and 20'' of the coil 10, shown in one preferred embodiment, with each coil turn having a rectangular cross-section. Dimension D1, the thickness of a coil turn is constant and dimension D2, the width of a coil turn is variable, in accordance with the present invention, while dimension D3, the spacing between two adjacent coil turns, is preferably constant and sized depending on the maximum coil turn-to-coil turn voltage drop in the coil 10. Having dimension D3 constant simplifies the machining process, but having that dimension constant is not necessary for the practicing of the present invention.

FIG. 5(*b*) is a cross-sectional view of adjacent coil turns 30, 30', and 30'' of the coil 10, shown in another preferred embodiment, in which the coil turns have formed therebetween a brush guide groove 31. The outer periphery of the coil 10 is at the top of the figure. The brush guide groove 31 is formed by removing a segment of each of two adjacent coil turns, such as the coil turns 30' and 30' so as to form the groove to slidingly accommodate a nonconducting brush guide 32 therein. Dimension D4, the width of the brush guide groove 31, is preferably constant throughout the length of the coil 10. The brush guide 32, a contact brush 33, and a brush holder 34 are mutually fixedly attached. The contact brush 33 bears against the outer periphery of the coil turns for electrical contact. In the preferred embodiment shown, dimension D5 is variable and the width of the brush 33 is dimensioned such that it approximates the smallest D5 dimension. The brush guide groove could also be formed by removing a segment of only one edge of each coil turn of the coil 10.

With a typical coil turn 30 having a thickness dimension, D1, on the order of about ¾-inch, dimension D4 might be on the order of about ⅛-inch and dimension D3 might be on the order of about 0.03-inch, while the depth of the groove 31 might be on the order of about ¼-inch. Having the stepped configuration resulting from the relative values of dimension D4 and dimension D3 permits dimension D3 to be machined with a relatively narrow tool, without requiring that such narrow tool have a length as great as the dimension D1 of the coil turn. While these approximate values of the dimensions are preferable for one construction according to the present invention, other values may be suitable, as well, depending on the level of current carried in the coil 10 and other factors. Also, it is not necessary that the cross-sectional shape of the groove 31 be rectangular, but the groove may have other configurations if desired.

FIG. 5(*c*) shows another preferred embodiment of the present invention in which a guide groove 41, preferably having a constant dimension D6, is provided in the outer peripheral surface of each of adjacent coil turns 40, 40', and 40'' to accommodate a contact brush 42 that is fixedly attached to a brush holder 43. In this embodiment, the contact brush 42 serves as its own guide, thus simplifying the construction. A further advantage of this embodiment is that a relatively large brush-to-coil turn contact surface may be provided, thus extending the life of the brush.

While the preferred cross-sectional shapes of individual turns of the coil 10 are generally rectangular, for reasons of economy, any of a number of cross-sectional shapes may be provided within the intent of the present invention.

The coil 10 may be cut from a solid tube of electrical grade copper. Prior to cutting the contoured turns, the coil is stabilized by threading the inside diameter of the copper tube, screwing it onto the outside diameter of a threaded tube of the insulating material 11, and bonding these two pieces together. The bonding may be achieved by vacuum impregnating the assembly with transformer varnish, thus thoroughly stabilizing the future coil. After this stabilization process has been completed, the coil is cut from the copper tube by numerically controlled machining. Numerically controlled machining can easily vary the pitch of the cuts made through the copper tube, thus achieving the desired coil conductor width variances through simple numerically controlled programming.

The completed coil, stabilized on the insulating tube, requires very little finish machining. The procedure also allows an accurate brush guide to be easily machined into the coil, as shown on FIGS. 5(*b*) and 5(*c*), if the coil is of the type requiring a contact brush.

In addition to producing an economical coil, another advantage of the present invention is in eliminating complicated manufacturing processes and costly tooling. Specifically, it eliminates the need for winding/coiling rectangular or square wire and the complicated process of accurately positioning and stabilizing turns of the transformer's coil.

While the present invention has been described as applied to a conductor in the form of a cylindrical helix, it will be understood that it is applicable to other inductor devices with other shapes of conductors such as toroids. It will also be understood that it is not necessary that the coil be mounted on an insulating tube.

It will be understood that what has been disclosed is a novel method of making a current conductor for inductor devices of the type having varying current densities along the conductor, the conductor having a contoured cross-section such that the cross-sectional area of the conductor varies substantially directly as the current carrying requirements of the conductor vary.

Since certain changes may be made in carrying out the above invention without departing from the scope thereof, it is intended that all matter contained in the above description or shown on the accompanying drawing figures shall be interpreted as illustrative only and not in a limiting sense.

It is also intended that the following claims are intended to cover all of the generic and specific features of the invention herein described, and all statements of the scope of the invention which, as a matter of language, might be said to fall therebetween.

We claim:

1. A method of forming a conductor for an induction device having varying current carrying requirements along the length of the conductor, comprising the steps of:

(a) providing a tubular member of conductive material; and (b) machining the tubular member to form (1) a coil with the cross sectional area of the conductor forming the coil substantially continuously varying along its length in proportion to the varying current carrying requirements.

2. Claim 1, further defined, wherein step (b) is accomplished by numerically controlled machining.

3. Claim 1, further defined, wherein the tubular member is a cylinder.

4. Claim 1, further defined, wherein the tubular member is mounted on an insulating tube prior to machining.

5. Claim 4, further defined, wherein the inside diameter of the tubular member is threaded and the tubular member is mounted on the insulating tube by screwing it onto threads on the outside diameter of the insulating tube.

6. Claim 4, further defined, wherein the tubular member and the insulating tube are bonded together by vacuum impregnating the assembly with transformer varnish.

7. Claim 1, further defined, wherein said contact brush guide groove is formed in at least one edge of each turn of the conductor.

8. Claim 1, further defined, wherein said contact brush guide groove is formed in each turn of the conductor between the edges of each turn.

* * * * *

UNITED STATES PATENT AND TRADEMARK OFFICE
CERTIFICATE OF CORRECTION

PATENT NO. : 4,894,907

DATED : January 23, 1990

INVENTOR(S) : Julian A. Watt, et al

It is certified that error appears in the above-identified patent and that said Letters Patent is hereby corrected as shown below:

Claim 1 should read as follows:

---1. A method of forming a conductor for an induction device having varying current carrying requirements along the length of the conductor, comprising the steps of:

(a) providing a tubular member of conductive material; and (b) machining the tubular member to form (1) a coil comprising a number of turns of an elongated conductor, with the cross sectional area of the conductor forming the coil substantially continuously varying along its length in proportion to the varying current carrying requirements and (2) a conduct brush guide groove

UNITED STATES PATENT AND TRADEMARK OFFICE
CERTIFICATE OF CORRECTION

PATENT NO. : 4,894,907

DATED : January 23, 1990

INVENTOR(S) : Julian A. Watt, et al

It is certified that error appears in the above-identified patent and that said Letters Patent is hereby corrected as shown below:

extending along the length of said conductor. ---

Signed and Sealed this

Nineteenth Day of February, 1991

*Attest:*

HARRY F. MANBECK, JR.

*Attesting Officer*

*Commissioner of Patents and Trademarks*